US010367303B1

(12) United States Patent
O'Donnell et al.

(10) Patent No.: US 10,367,303 B1
(45) Date of Patent: Jul. 30, 2019

(54) ZIP-LOCKER RECEIVER APPARATUS

(71) Applicant: EMC IP Holding Company LLC, Hopkinton, MA (US)

(72) Inventors: Sean P. O'Donnell, Brookline, MA (US); David Boudreau, Littleton, MA (US); Albert F. Beinor, Jr., Sutton, MA (US); C. Ilhan Gundogan, Lexington, MA (US); Ralph C. Frangioso, Jr., Franklin, MA (US); Robert P. Wierzbicki, Worcester, MA (US)

(73) Assignee: EMC IP Holding Company LLC, Hopkinton, MA (US)

( * ) Notice: Subject to any disclaimer, the term of this patent is extended or adjusted under 35 U.S.C. 154(b) by 67 days.

(21) Appl. No.: 15/403,308

(22) Filed: Jan. 11, 2017

Related U.S. Application Data

(63) Continuation of application No. 14/231,142, filed on Mar. 31, 2014, now Pat. No. 9,585,442.

(51) Int. Cl.
*H01R 13/639* (2006.01)

(52) U.S. Cl.
CPC ..... *H01R 13/6392* (2013.01)

(58) Field of Classification Search
CPC ..... H01R 13/6271; H01R 13/6272; H01R 13/62933; H01R 13/62977; H01R 13/633; H01R 13/627; H01R 13/62; H01R 13/629; H01R 2201/04; H01R 2201/06; H01R 13/6392; H01R 13/639; H01R 13/6395; H01R 13/6273; H01R 13/623; H01R 13/625; A44B 19/38
USPC ..... 439/369, 371, 299, 345
See application file for complete search history.

(56) References Cited

U.S. PATENT DOCUMENTS 8,535,083 B1 * 9/2013 Gong ..... H01R 13/6395 439/371

* cited by examiner

*Primary Examiner* — Jack W Lavinder
(74) *Attorney, Agent, or Firm* — Ryan, Mason & Lewis, LLP

(57) ABSTRACT

Example embodiments of the present invention relate to an apparatus comprising a zip-locker receiver. The zip-locker receiver is configured to ratchetably receive a zip-locker and comprises an aperture and a pawl disposed within the aperture configured to complement and cooperate with the ratchet teeth of the zip-locker to prevent removal of the zip-locker from the aperture of the zip-locker receiver at times the pawl of the zip-locker receiver is engaged with the ratchet teeth of the zip-locker.

18 Claims, 8 Drawing Sheets

ZIP-LOCKER RECEIVER APPARATUS

CROSS REFERENCE TO RELATED APPLICATIONS

This Application is a Continuation of U.S. patent application Ser. No. 14/231,142 entitled "ZIP-LOCKER SYSTEM AND APPARATUS" filed Mar. 31, 2014, hereby incorporated herein by reference in its entity.

A portion of the disclosure of this patent document may contain command formats and other computer language listings, all of which are subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

TECHNICAL FIELD

This application relates to managing cables while preventing accidental disconnection in congested environments.

BACKGROUND

Conventionally available clamp devices of the noted type fall into two general classifications.

There are clamp devices formed of polymeric material which include an elongate strap component having an integral eye or anchor portion at one end. Devices of this type are illustrated, by way of example, in U.S. Pat. No. 3,660,869, issued May 9, 1972, and U.S. Pat. No. 4,009,509, issued Mar. 1, 1977. Such devices typically include a multiplicity of transversely directed teeth along the length of the strap on one surface thereof. The eye or anchor end includes a pawl which is angularly oriented with respect to the teeth in such manner that the teeth are permitted to pass freely through the eye in one direction, with a consequent deflection of the pawl. The geometry of the pawl and teeth is arranged to preclude retractile movement of the band through the anchor.

When the device is tightened about an article or articles to be connected, i.e. a hose or flexible connector fitting sleeved over a duct end, etc. the tightened band functions to compress the outer encircling component against the duct so as to prevent fluid leaks from the spaces between the components.

A further conventionally available clamp device is comprised of an elongate metal strip having a multiplicity of closely spaced perforations angularly oriented relative to the longitudinal axis of the strip. One end of the strip carries a fixture in which is rotatably mounted the equivalent of a worm gear or thread, the periphery of which is inclined relative to the longitudinal axis of the strip to correspond with the angles of the perforations in the strip.

SUMMARY

Example embodiments of the present invention relate to an apparatus comprising a zip-locker receiver. The zip-locker receiver is configured to ratchetably receive a zip-locker and comprises an aperture and a pawl disposed within the aperture configured to complement and cooperate with the ratchet teeth of the zip-locker to prevent removal of the zip-locker from the aperture of the zip-locker receiver at times the pawl of the zip-locker receiver is engaged with the ratchet teeth of the zip-locker.

BRIEF DESCRIPTION OF THE DRAWINGS

The above and further advantages of the present invention may be better under stood by referring to the following description taken into conjunction with the accompanying drawings in which.

DETAILED DESCRIPTION

Figure 1A:
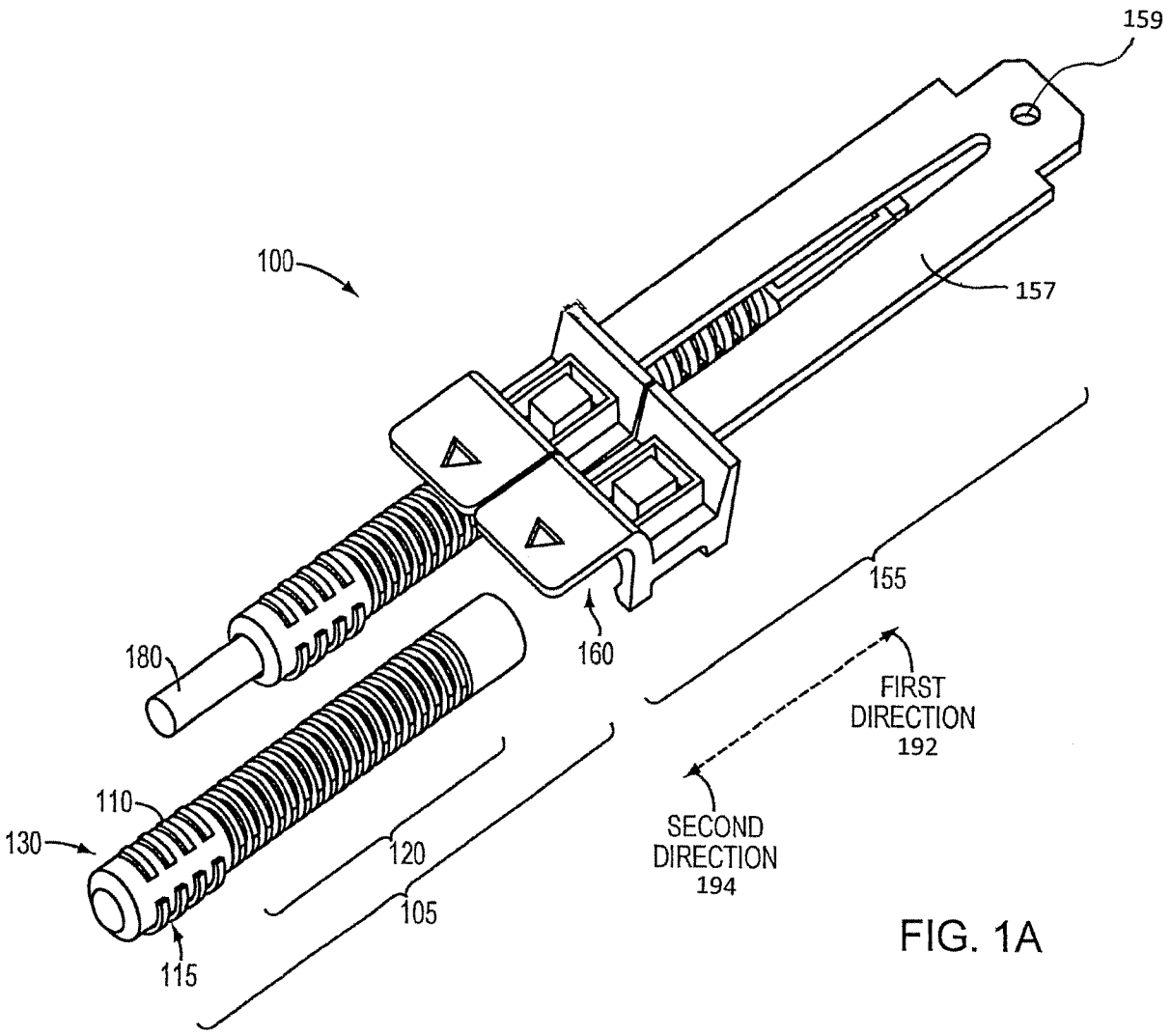
FIGS. 1A and 1B are illustrations of a zip-locker system according to an example embodiment of the present invention from a top view and a bottom view, respectively.
Figure 1B:
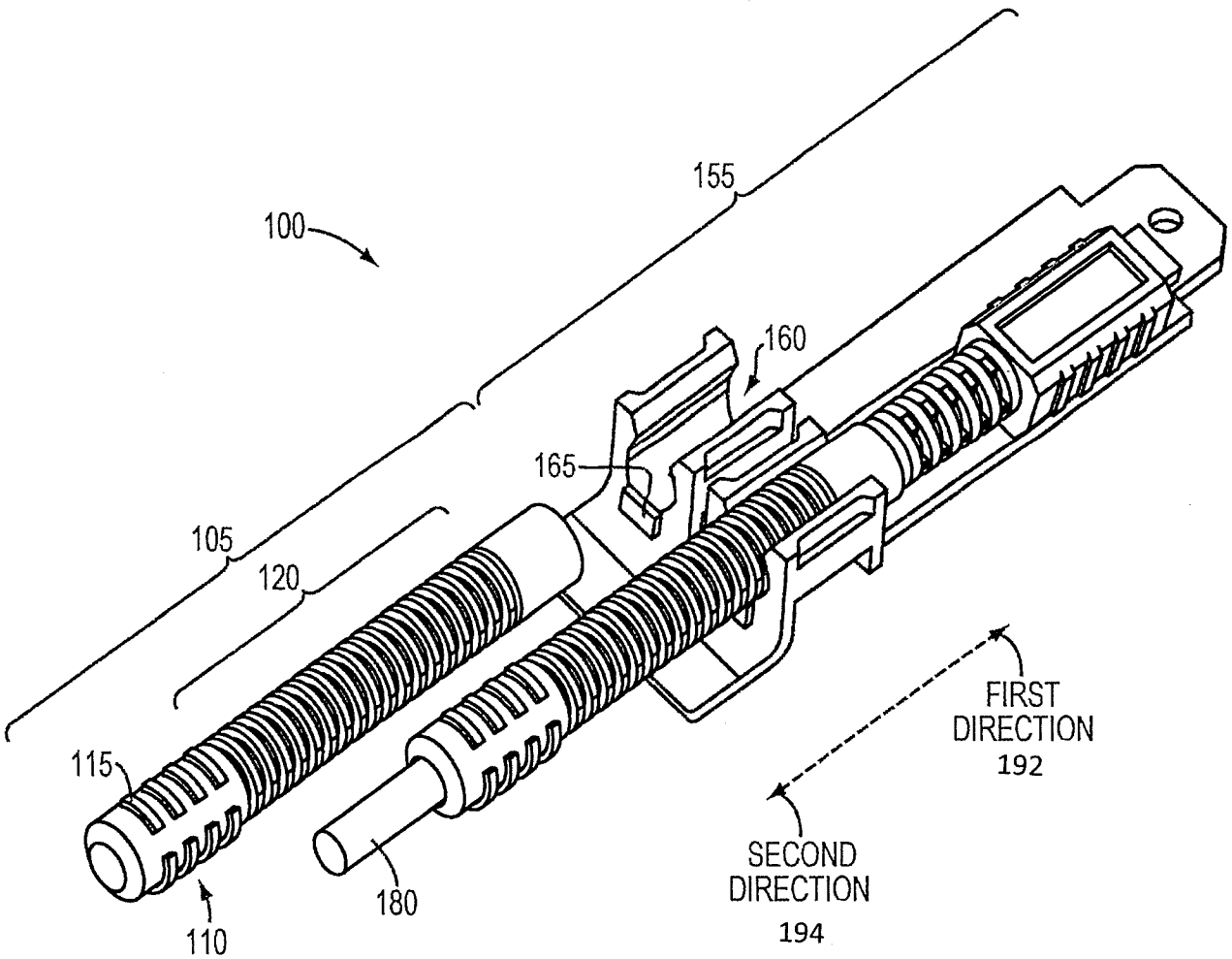

FIGS. 1A and 1B are illustrations of a zip-locker system 100 according to an example embodiment of the present invention from a top view and a bottom view, respectively. FIGS. 1C-1F are cross-sectional diagrams of a zip-locker system according to an example embodiment of the present invention. As illustrated in FIGS. 1A-1F, the zip-locker system 100 includes a zip-locker 105 and a zip locker receiver 155.

The zip-locker comprises a first portion 110 and a second portion 115. The first portion 110 and the second portion 115 are configured to cooperatively fasten to an interconnect 180. At least one of the first portion 110 and the second portion 115 includes ratchet teeth 120 formed and extending longitudinally on an outer surface thereof. The zip-locker 105 may include other features, including an insertion direction indicator 125 and one or more manipulation aids 130 for grasping the zip-locker 105 and manipulating it into the zip-locker receiver 155 as described below in greater detail. The zip-locker 105 also may be color coded to indicate compatibility with a particular interconnect type.

The zip-locker 105 may be configured to be inserted into the aperture 160 of the zip-locker receiver 155 in a first direction 192 through the aperture 160. The zip-locker receiver 155 may be configured to ratchetably receive the zip-locker 105 and comprises an aperture 160 and a pawl 165 disposed within the aperture 160 configured to complement and cooperate with the ratchet teeth 120 of the zip-locker 105 at times the pawl 165 of the zip-locker receiver 155 is engaged with the ratchet teeth 120 of the zip-locker 105. Therefore, the aperture 160 and the pawl 165 may be configured to prevent removal of the zip-locker 105 from the aperture 160 in a second direction 194 substantially opposite the first direction 192 in which the zip-locker 105 was inserted into the aperture 160.

As illustrated in FIGS. 1A and 1B, the zip-locker receiver 155 may comprise a plurality of apertures 160 each having a respective pawl 165, configured to engage with respective zip-lockers 105. However, it should be understood that the system also may comprise a single zip-locker 105/zip-locker receiver 155 pair. The zip-locker receiver 155 may include a connector segment or connector 157 configured to be mounted to a computer device as discussed in connection with FIG. 5 below, and an aperture 159 to receive a fastener or the like to facilitate securement to the computer device.

Figure 1C:
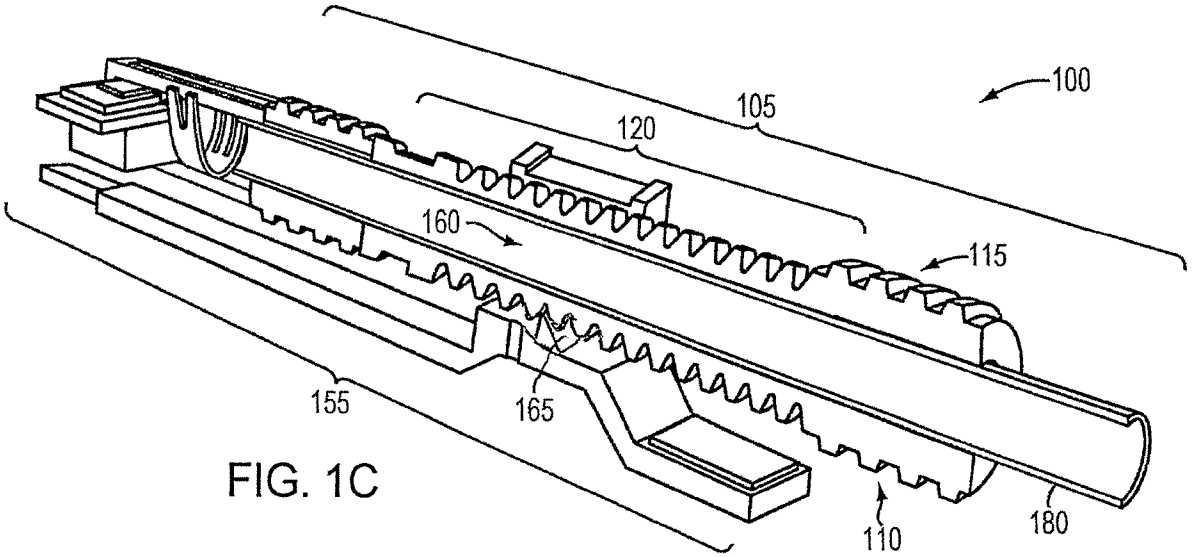
FIGS. 1C-1F are cross-sectional views of a zip-locker system according to an example embodiment of the present invention.
Figure 1D:
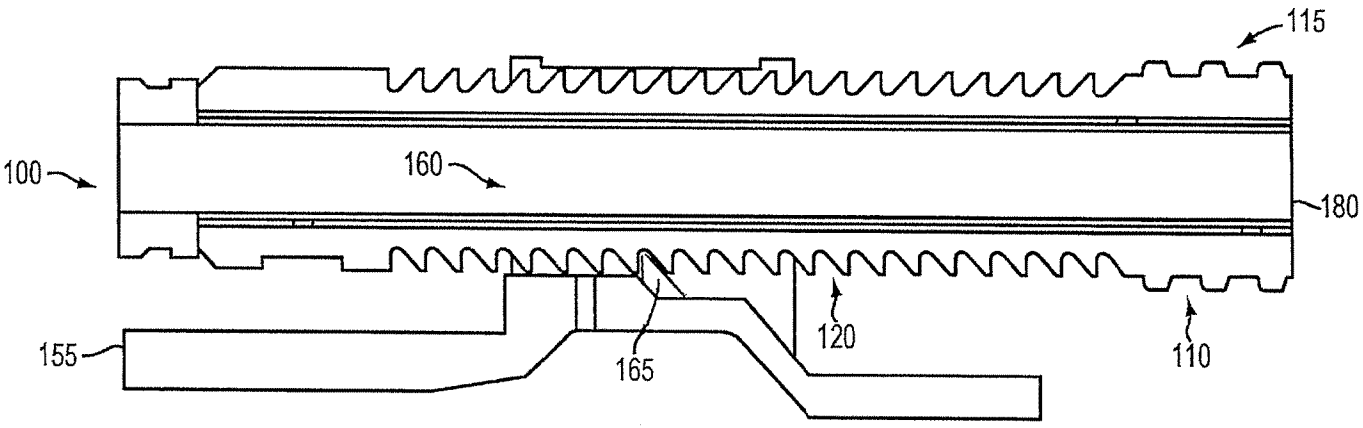
Figure 1E:
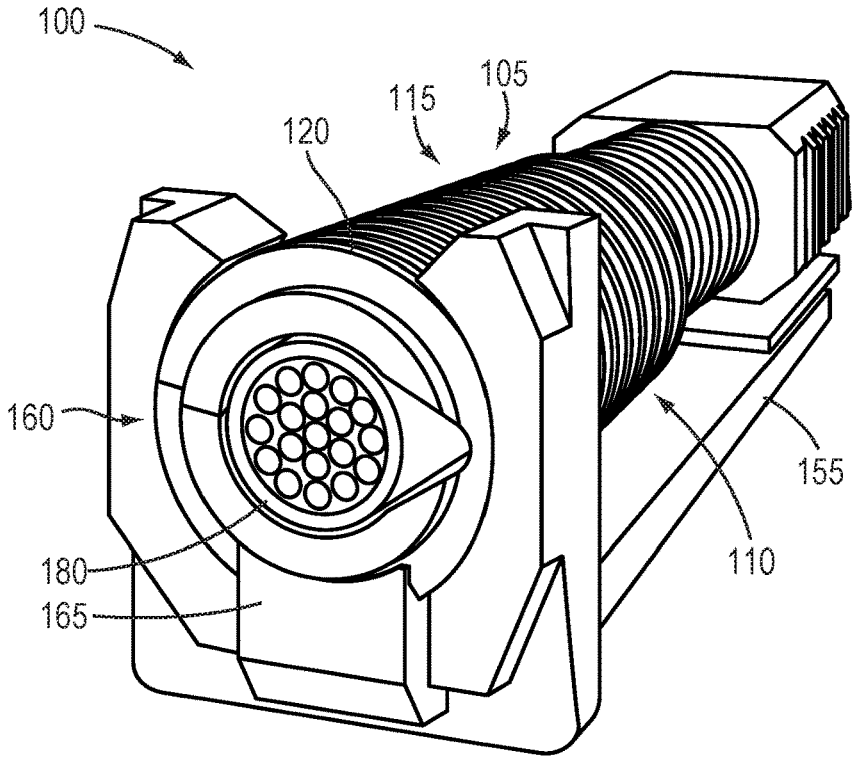
Figure 1F:
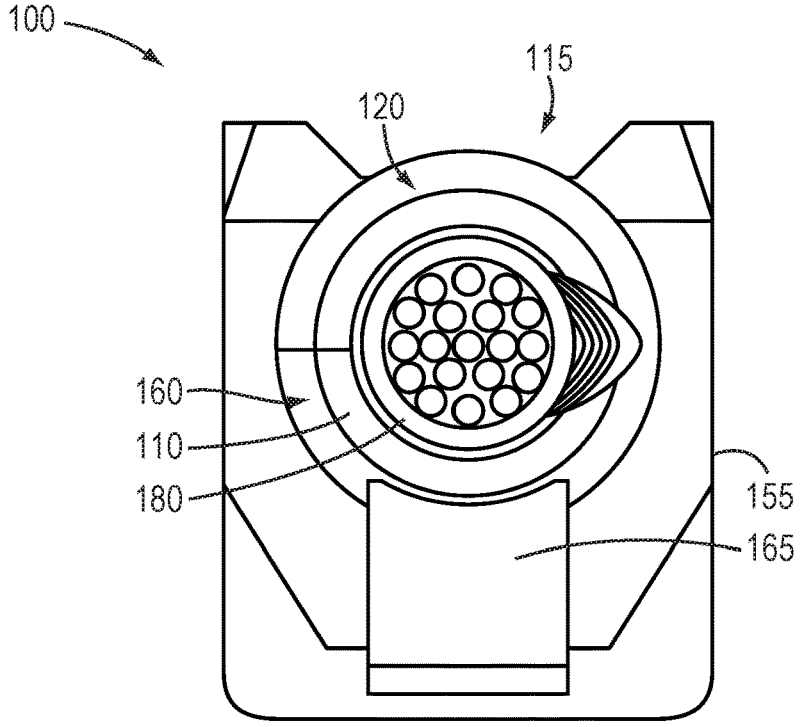
Figure 2A:
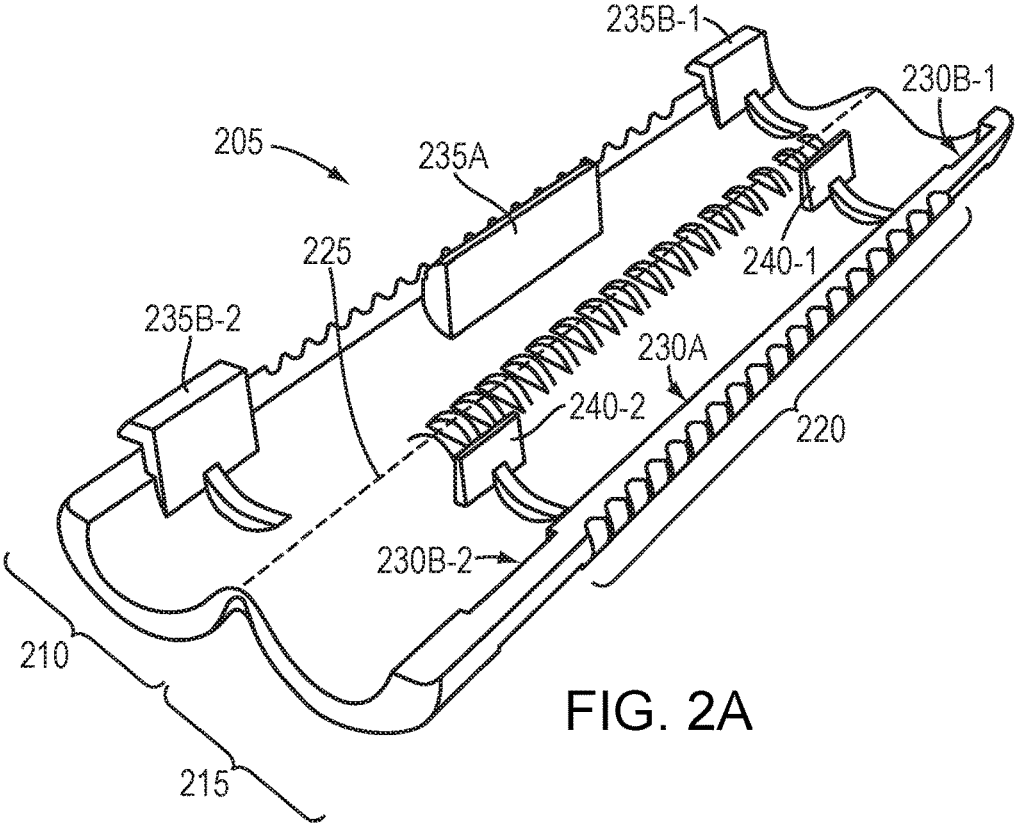
FIGS. 2A and 2B are illustrations of a zip-locker according to an example embodiment of the present invention from a first end and a second end, respectively.
Figure 2B:
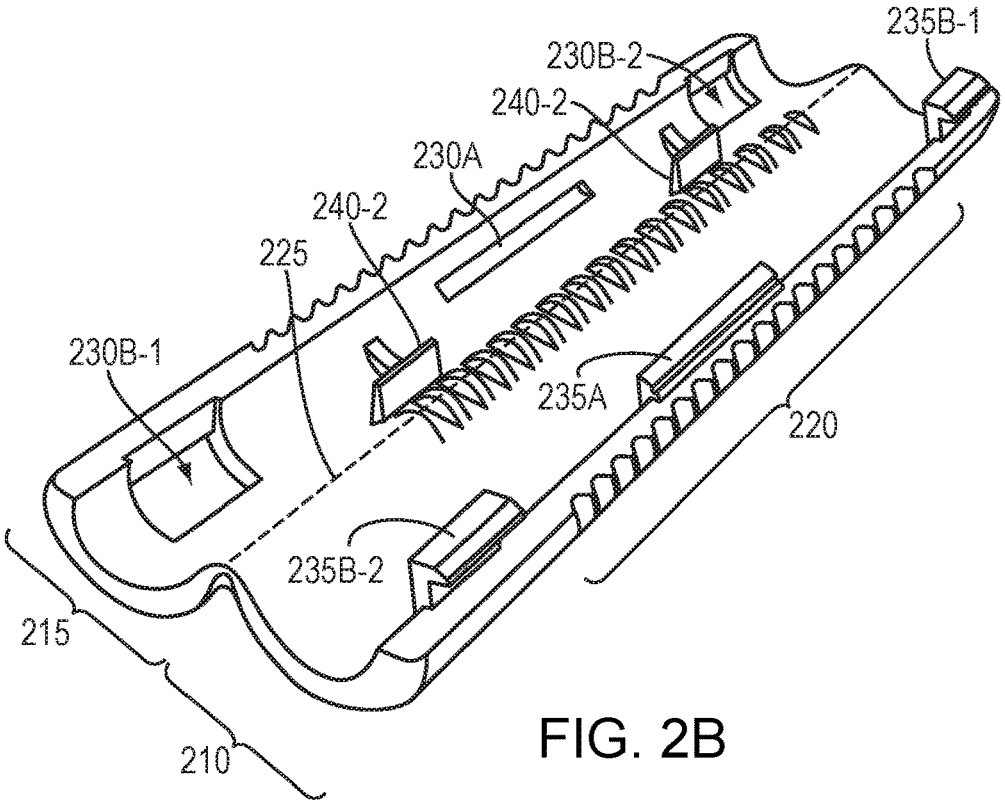

FIGS. 2A and 2B are illustrations of a zip-locker 205 according to an example embodiment of the present invention from a first end and a second end, respectively. As illustrated in FIGS. 2A and 2B, the zip-locker 205 comprises a first portion 210 and a second portion 215. At least one of the first portion 210 and the second portion 215 includes ratchet teeth 220 formed and extending longitudinally on an outer surface thereof. As illustrated in FIGS. 2A and 2B, the first portion 210 and the second portion 215 may be joined along an edge 225 and hingedly configured to fasten to the interconnect (interconnect 180 of FIGS. 1A-1C) along the edge 225. However, it should be understood that, in other embodiments, the first portion 210 and the second portion 215 may not be joined along the edge 225. Rather, the first portion 210 and the second portion 215 may be distinct components that may snap together, such as by using tab locks as described below, or other fasteners, such as mechanical fasteners (e.g., screws and clamps), chemical fasteners (e.g., glue or other adhesives), or by melting the first portion 210 and the second portion 215 together.

The second portion 215 includes a tab lock 230A and the first portion 210 includes a tab 235A. In certain embodiments, as illustrated in FIGS. 2A and 2B, the tab lock 230A may be a primary tab lock 230A and the tab 235A may be a primary tab 235A. The second portion 215 also may include one or more secondary tab locks 230B-1, 230B-2 and the first portion 210 may include one or more secondary tabs 235B-1, 235B-2. The tabs (235A, 235B-1, 235B-2) (235 generally) are configured to complement and cooperate with the respective tab locks (230A, 230B-1, 230B-2) (230 generally) to prevent unfastening of the first portion 210 and the second portion 215 from the interconnect (interconnect 180 of FIGS. 1A-1C) at times the tab lock 230 is engaged with the tab 235. In other words, the interconnect (interconnect 180 of FIGS. 1A-1C) may be placed within the zip-locker 205 in an open state and the zip-locker 205 may be "folded" closed along the hinged edge 225, with the tabs 235 engaging with the tab locks 230 to prevent "unfolding" of the first portion 210 and the second portion 215.

The second portion 215 also includes a plurality of grippers 240-1, 240-2 (240 generally) extending substantially perpendicularly from an inside surface of the second portion 215 configured to grip the interconnect (interconnect 180 of FIGS. 1A-1C) to prevent lateral movement of the zip-locker 205 coaxially with the interconnect (interconnect 180 of FIGS. 1A-1C) at times the zip-locker 205 is fastened to the interconnect (interconnect 180 of FIGS. 1A-1C). In other words, the gripper 240 may apply pressure to the jacket of the interconnect so that the zip-locker 205 cannot slide easily along the interconnect.

Figure 3A:
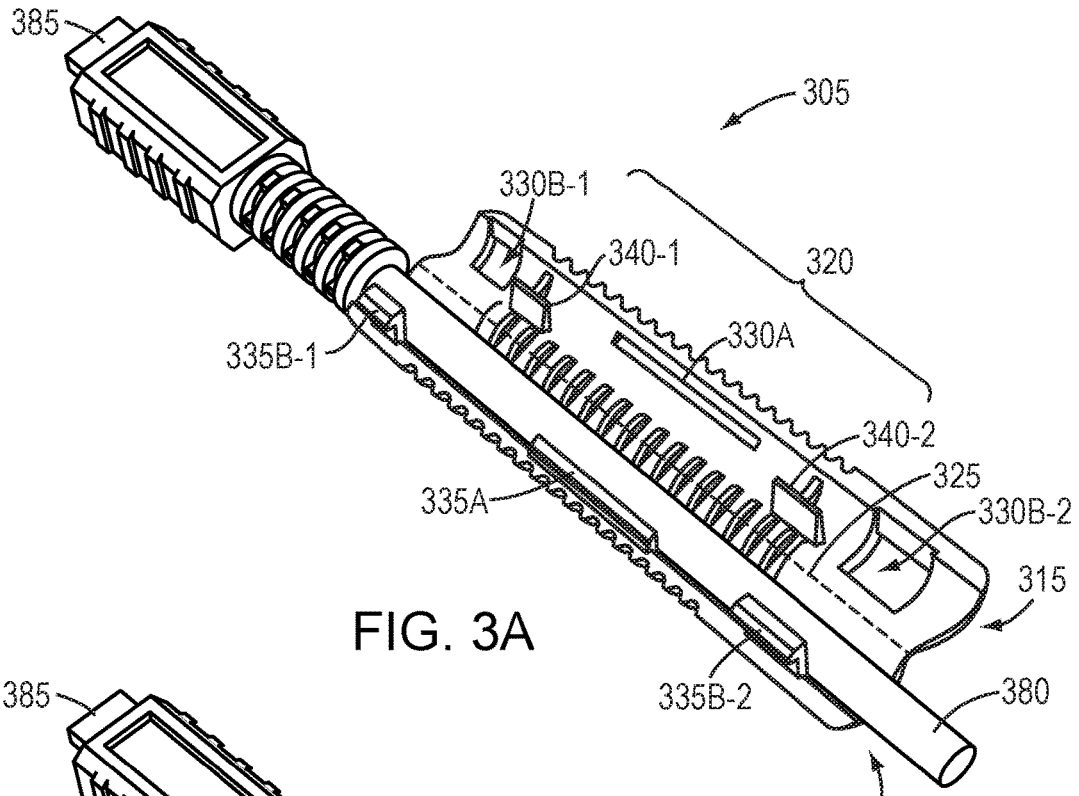
FIGS. 3A and 3B are illustrations of a zip-locker engaged with an interconnect in an unclamped and a clamped state, respectively.
Figure 3B:
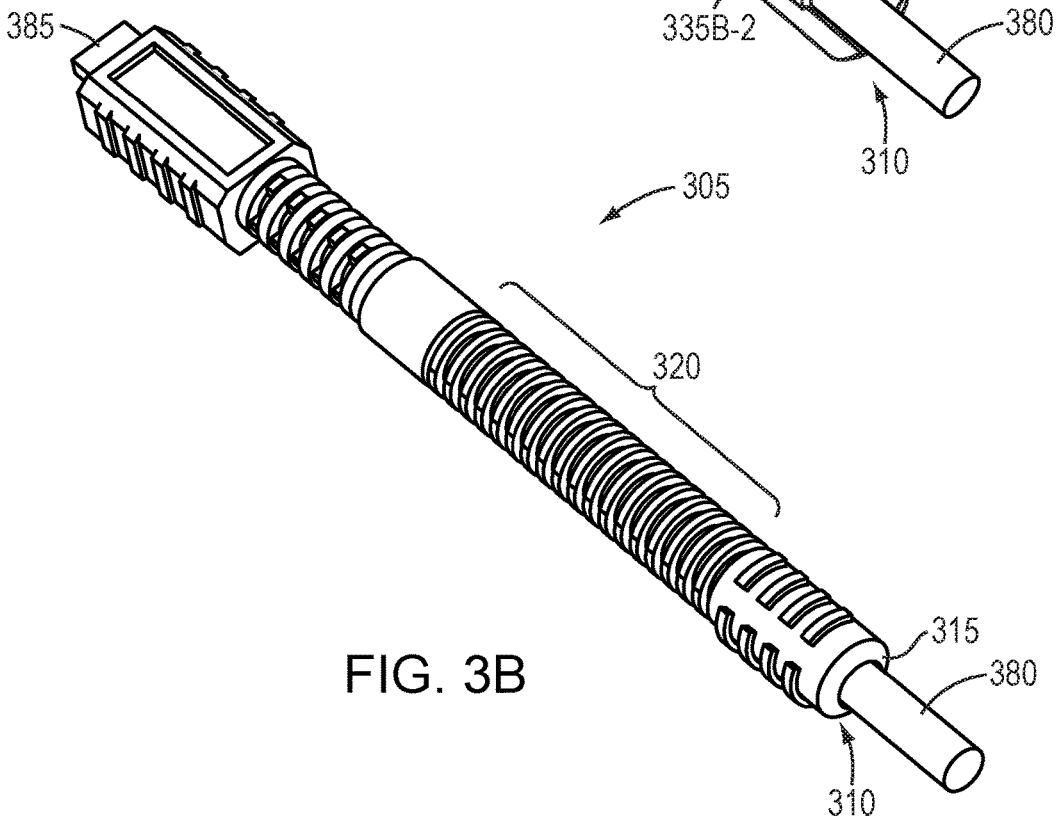

FIGS. 3A and 3B are illustrations of a zip-locker engaged with an interconnect in an unclamped and a clamped state, respectively. As illustrated in FIGS. 3A and 3B, the zip-locker 305 comprises a first portion 310 and a second portion 315 respectively having a plurality of ratchet teeth 320 formed and extending longitudinally on an outer surface thereof. As illustrated in FIGS. 3A and 3B, the first portion 310 and the second portion 315 may be joined along an edge 325 and hingedly configured to fasten to the interconnect 380 along the edge 325. The interconnect may include a plug 385 configured to plug into a jack on a computer device (not shown). The first portion 310 and the second portion 315 also may include a tabs 335A, 335B-1, 335B-2 (335 generally) configured to complement and cooperate with the respective tab locks 330A, 330B-1, 330B-2 (330 generally) to prevent unfastening of the first portion 310 and the second portion 315 from the interconnect 380 at times the tab lock 330 is engaged with the tab 335. In other words, the interconnect 380 may be placed within the zip-locker 305 in an open state (as illustrated in FIG. 3A) and the zip-locker 305 may be 'folded' closed along the hinged edge 325, with the tabs 335 engaging with the tab locks 330 to prevent 'unfolding' of the first portion 310 and the second portion 315 (as illustrated in FIG. 3B).

Figure 4A:
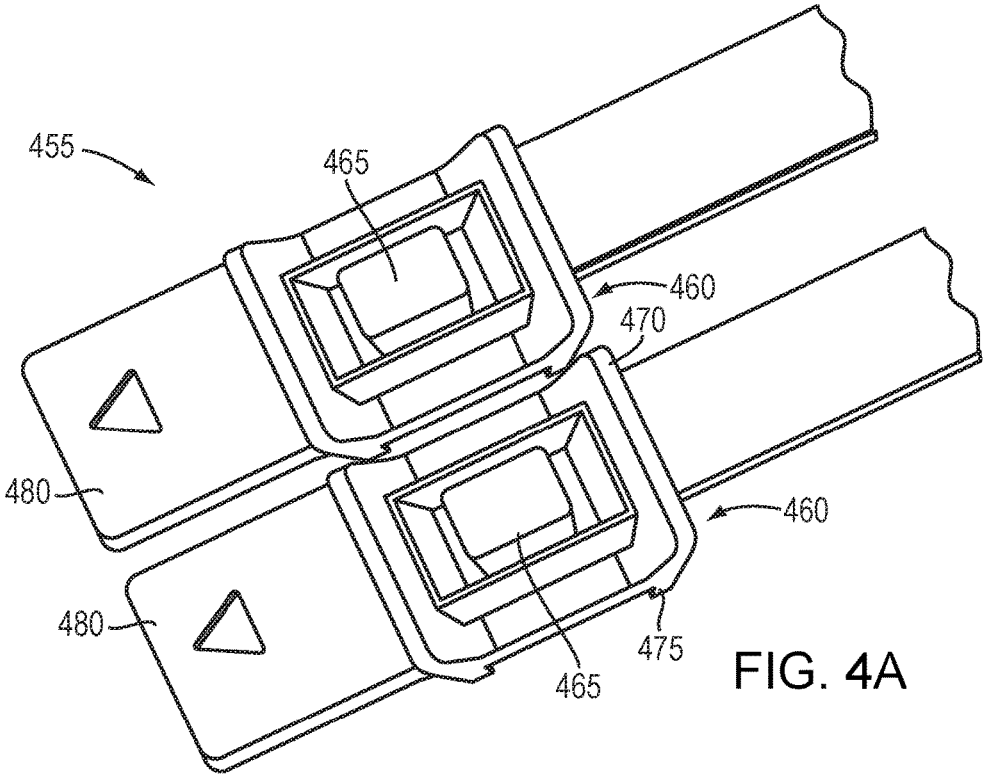
FIGS. 4A and 4B are illustrations of a zip-locker receiver according to an example embodiment of the present invention from a top view and a bottom view, respectively.
Figure 4B:
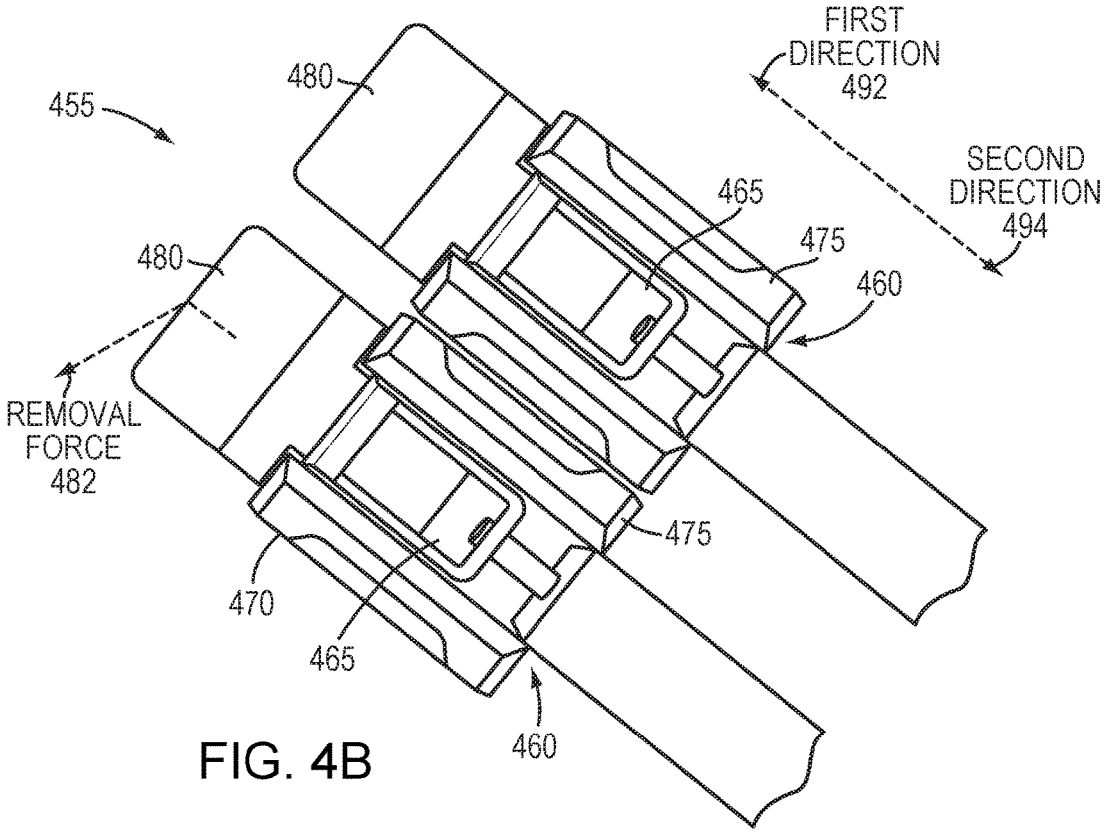

FIGS. 4A and 4B are illustrations of a zip-locker receiver 455 according to an example embodiment of the present invention from a top view and a bottom view, respectively. The zip-locker receiver 455 may be configured to ratchetably receive the zip-locker (zip-locker 305 of FIG. 3B) and comprises an aperture 460 and a pawl 465 disposed within the aperture 460 configured to complement and cooperate with the ratchet teeth of the zip-locker (ratchet teeth 320 of zip-locker 305 of FIG. 3B) at times the pawl 465 of the zip-locker receiver 455 is engaged with the ratchet teeth. Therefore, the aperture 460 and the pawl 465 may be configured to prevent removal of the zip-locker from the aperture 460 in a second direction 494 substantially opposite the first direction 492 in which the zip-locker was inserted into the aperture 460.

As illustrated in FIGS. 4A and 4B, the aperture 460 may comprise a first arm 470 and a second arm 475 configured to flexibly enable removal of the zip-locker from the aperture 460 by application of a removal force 482 to the zip-locker receiver 455 substantially between the first arm 470 and the second arm 475. For example, the removal force 482 may be applied to a zip-locker removal tab 480 to pull "up" on the zip-locker receiver 455. Application of the removal force 482 on the zip-locker removal tab 480 inherently applies force to the first arm 470 and the second arm 475 which, as described above, are configured to flexibly enable removal of the zip-locker from the aperture 460. In other words, the first arm 470 and the second arm 475 are enabled to flex "outward" from the aperture 460 to enable the first arm 470 and the second arm 475 to release their grip on the zip-locker 405. Such transposition of the aperture 460 increases a distance between the pawl 465 and the ratchet teeth of zip-locker such that the pawl is no longer engage with the ratchet teeth of the zip-locker, thereby enabling the zip-locker to be release from the aperture 460. In other embodiments, the zip-locker 405 may be disengaged from the zip-locker receiver 455 by pushing the zip-locker 405 clear through the aperture 460. In yet other embodiments, the pawl 465 may include a pawl release trigger configured to disengaged the pawl 465 from the ratchet teeth of the zip-locker to enable removal of the zip-locker from the aperture of the zip-locker receiver. In other words, the removal force applied to the pawl release trigger may pull the pawl back such that it is not engaged with the ratchet teeth of the zip-locker.

Figure 5:
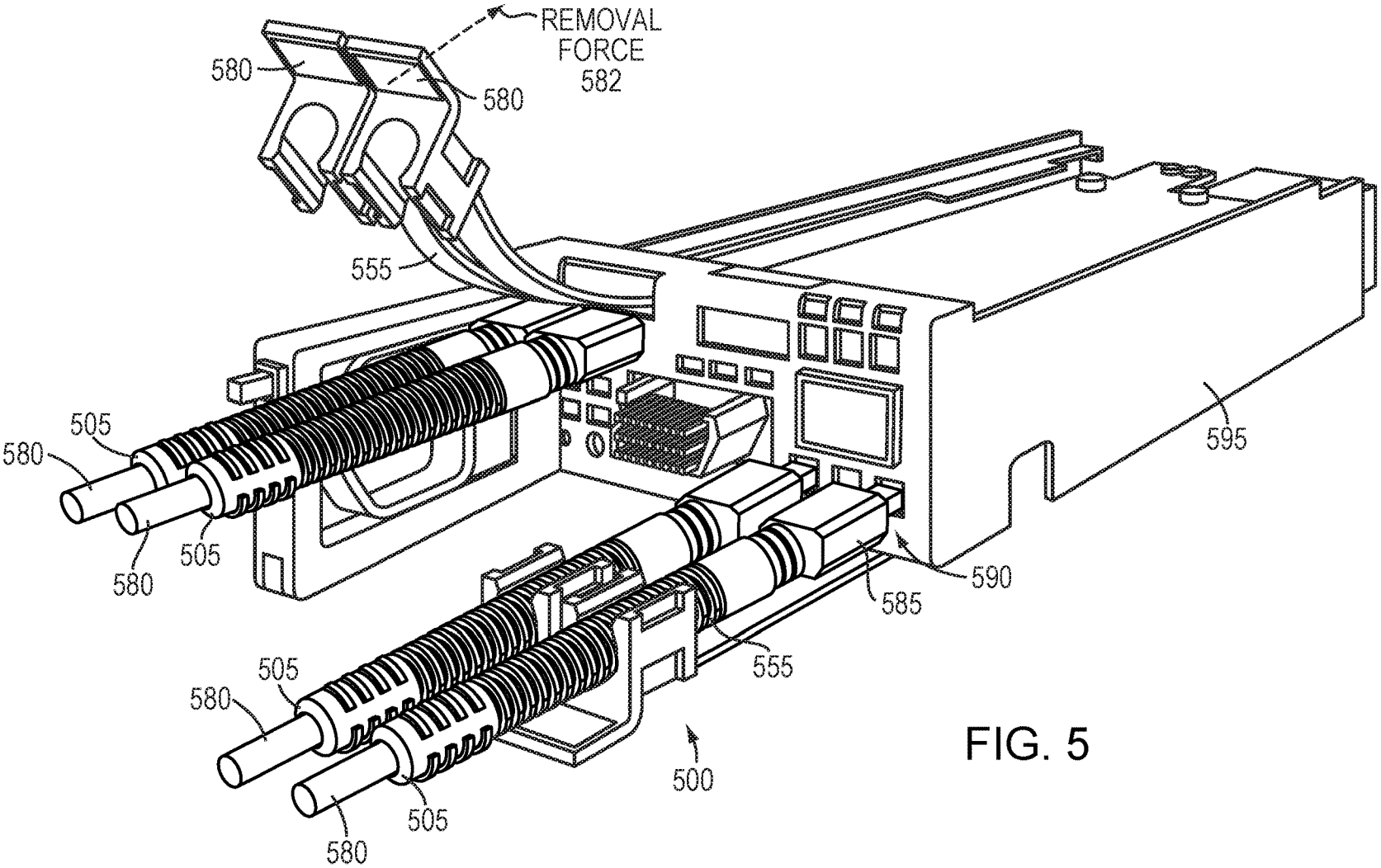
FIG. 5 is an isometric illustration of a plurality of zip-lockers engaged with a plurality of respective interconnects connected to ports of a computer device, with some zip-locker receiver engaged with their respective zip-lockers and other zip-locker receivers disengaged with their respective zip-lockers.

FIG. 5 is an isometric illustration of a plurality of zip-lockers 505 engaged with a plurality of respective interconnects 580 connected to ports 590 of a computer device 595, with some zip-locker receivers 555 engaged with their respective zip-lockers 505 and other zip-locker receivers 555 disengaged with their respective zip-lockers 505. As illustrated in FIG. 5, the zip-locker receiver 555 may be mounted to an edge of the computer device 595 such that the zip-locker system may substantially align the interconnect 580 toward a target, such as a port 590. Therefore, the zip-locker system enables a user to prevent removal of interconnects 580 from ports 590 that do not include a cable restrain. For example, RJ-45 and serial connectors generally include a cable restraint to prevent removal of the connector from the port (e.g., a tab or screws). However, USB and HDMI connectors, for example, do not include a cable restraint and are easily removed from their respective ports, often inadvertently. Therefore, example embodiments of the present invention prevent inadvertent removal of such interconnects from their respective ports. Further, the zip-locker 505 assists a user in making connections in tight spaces by providing a longer, stiffer portion to grasp onto when inserting the interconnect 580 into a port 590. Moreover, inserting the interconnect/zip-locker 505 pair through the aperture 560 substantially aligns the interconnect 580 toward its port.

As illustrated in FIG. 5, the zip-locker receiver 555 may be constructed of a material allowing flexing of the zip-locker receiver 555. Therefore, application of the removal force 582 may flex the zip-locker receiver 555 away from the zip-locker 505 to enable removal of the interconnect 580 from the port 590.

Although the foregoing invention has been described in some detail for purposes of clarity of understanding, it will be apparent that certain changes and modifications may be practiced within the scope of the appended claims. Accordingly, the present implementations are to be considered as illustrative and not restrictive, and the invention is not to be limited to the details given herein, but may be modified within the scope and equivalents of the appended claims.

What is claimed is:

1. A zip-locker receiver for receiving a zip-locker having a plurality of ratchet teeth on an outer surface thereof, comprising:

a receiver member including first and second arms defining an aperture therethrough, the aperture configured to at least partially receive the zip-locker; and a pawl mounted to the receiver member and disposed within the aperture;

wherein the pawl is configured to complement and cooperate with the ratchet teeth of the zip-locker to ratchetably receive the zip-locker and to prevent removal of the zip-locker from the aperture of the receiver member when the pawl is engaged with the ratchet teeth of the zip-locker, the pawl being movable when the zip-locker is positioned within the aperture of the receiver member between an initial position to engage the ratchet teeth and a displaced position to permit ratcheting movement of the zip-locker relative to the pawl.

2. The zip-locker receiver of claim 1 wherein the first arm and the second arm are flexible, the first arm and the second arm configured to flex outwardly to permit removal of the zip-locker from the aperture of the receiver member.

3. The zip-locker receiver of claim 2 further comprising a receiver member removal tab configured for manual engagement to facilitate removal of the zip-locker relative to the aperture of the receiver member.

4. The zip-locker receiver of claim 1 wherein the receiver member is configured to substantially align an interconnect towards a target.

5. The zip-locker receiver of claim 1 wherein the receiver member is coupled to a computer.

6. The zip-locker receiver of claim 1 wherein the pawl is configured to permit movement of the zip-locker in a first longitudinal direction within the aperture and is configured to engage the ratchet teeth of the zip locker to resist movement of the zip-locker in a second longitudinal direction within the aperture.

7. The zip-locker receiver of claim 1 wherein the first and second arms are configured for movement between a closed position and an open position, the first and second arms configured to permit mounting and removal of the interconnect assembly relative to the aperture when in the open position.

8. The zip-locker receiver of claim 1 including two receiver members in side by side relation, each receiver member configured to receive an interconnect assembly and wherein each receiver member includes a corresponding pawl.

9. A locker receiver device mountable to a computer to secure a computer interconnect assembly relative to a port of the computer, the locker receiver device comprising:

a receiver member including first and second arms defining an aperture therethrough extending along a longitudinal axis, the aperture configured for at least partial reception of the interconnect assembly, the first and second arms configured for movement between a closed position and an open position, the first and second arms configured to permit mounting and removal of the interconnect assembly relative to the aperture when in the open position;

a pawl mounted to the receiver member within the aperture, the pawl configured to permit movement of the interconnect assembly within the aperture of the receiver member in a first longitudinal direction relative to the longitudinal axis when in the closed position of the first and second arms, the pawl configured to engage corresponding structure of the interconnect assembly to resist movement of the interconnect assembly within the aperture of the receiver member in a second longitudinal direction relative to the longitudinal axis when in the closed position of the first and second arms; and a connector connecting the receiver member to the computer adjacent the port of the computer.

10. The locker receiver device of claim 9 wherein the connector is configured to permit movement of the receiver member relative to the computer.

11. The locker receiver device of claim 9 wherein the first and second arms are configured to move radially outwardly relative to the longitudinal axis to move from the closed position to the open position.

12. The locker receiver device of claim 11 including a manually engageable tab coupled to the receiver member, the tab being manipulable in a direction away from the interconnect assembly to cause the first and second arms to move toward the open position thereby effecting release of the interconnect assembly from the receiver member.

13. The locker receiver device of claim 9 wherein the pawl is configured to engage ratchet teeth disposed on an exterior of the interconnect assembly when in the closed position of the first and second arms and when the interconnect assembly is positioned within the aperture of the receiver member.

14. The locker receiver device of claim 9 wherein the first and second arms are flexible, the first arm and the second arm configured to flex outwardly to permit removal of the zip-locker from the aperture of the receiver member when the first and second arms are in the closed position.

15. The locker receiver device of claim 9 wherein the receiver member is configured to align the interconnect assembly to the port of the computer when the interconnect assembly is mounted within the aperture of the receiver member.

16. The locker receiver device of claim 9 including two receiver members in side by side relation, each receiver member configured to receive an interconnect assembly.

17. The locker receiver device of claim 16 wherein each receiver member includes a corresponding pawl.

18. The locker receiver device of claim 17 wherein each pawl is configured to engage ratchet teeth disposed on an exterior surface of the respective interconnect assembly when in the closed position of the first and second arms of each receiver member.

* * * * *